US006016679A

United States Patent [19]

Ochi et al.

[11] Patent Number: 6,016,679

[45] Date of Patent: Jan. 25, 2000

[54] ROLLING MILL

[75] Inventors: Shigeharu Ochi, Niihama; Shou Inui, Tokyo; Mitsuru Watanabe, Uma-gun; Ryo Takeda, Kurashiki, all of Japan

[73] Assignees: Sumitomo Heavy Industries, Ltd., Tokyo; Kawasaki Steel Corporation, Kobe, both of Japan

[21] Appl. No.: 09/132,826

[22] Filed: Aug. 12, 1998

[30] Foreign Application Priority Data

Sep. 30, 1997 [JP] Japan ..... 9-284396
Sep. 30, 1997 [JP] Japan ..... 9-284397

[51] Int. Cl.[7] ..... B21B 31/07; B21B 31/24

[52] U.S. Cl. ..... 72/248; 72/237

[58] Field of Search ..... 72/248, 224, 237, 72/238, 240, 225, 226, 239

[56] References Cited

U.S. PATENT DOCUMENTS 4,581,911 4/1986 Shinomoto ..... 72/248

*Primary Examiner*—Rodney Butler
*Attorney, Agent, or Firm*—Nikaido, Marmelstein, Murray & Oram LLP

[57] ABSTRACT

A rolling mill having a plurality of roll units, a rolling-reduction adjusting device of an eccentric-cartridge type, and a roll-alignment adjusting device, all mounted on its housing. The housing is split into freely separable and joinable first and second housing segments. The housing segments have semicircular bearing-holder segments formed in their joint surfaces. The shafts of the roll units are held between the first and second housing segments by being journaled in eccentric cartridges which are fitted in the bearing holders consisting of the semicircular bearing-holder segments. The roll-alignment adjusting device includes adjusting mechanisms and chucks to connect the shaft ends of the roll units to the adjusting rods of the adjusting mechanisms. Each adjusting mechanism further comprises (i) an outer nut which is fixed to the housing and has internal threads, (ii) a middle nut which has internal and external threads, the external threads engaging the internal threads of the outer nut, and is rotated externally, and (iii) an adjusting rod which has external threads to engage the internal threads of the middle nut. A first thread joint is defined by the internal threads of the outer nut. An external thread is defined by the middle nut and the second thread joint by the internal threads of the middle nut and the external threads of the adjusting rod. The first and second thread joints are each given a thread of the opposite hand and a different pitch.

6 Claims, 19 Drawing Sheets

ROLLING MILL

BACKGROUND OF THE INVENTION

The present invention relates generally to a rolling mill, and more particularly to rolling mills such as four-, three-, and two-roll rolling mills to roll wires and bars. The invention also relates to a roll-alignment adjusting device of the rolling mill.

In rolling bars or wires with a rolling mill, rolling of different sizes within a certain range can be accomplished by adjusting the rolling reduction, but without the range the rolling mill has to be retooled with rolls with a rolling groove of suitable size.

If an iron factory is to produce bars or wires of various sizes in small quantities, frequent change of rolls is inevitable, which consumes a lot of labor and time.

For example, as is shown in FIG. 18, the four-roll rolling mill proposed by us in the Japanese Unexamined Patent Publication, No. 275906/H 7 (1995), (prior art I) has five casings; i.e., a center casing 101, upper and lower casings 102 and 103, and a pair of right and left idle-roll brackets 104 and 105. Two roll units R1 each having one of the paired vertical rolls 1 and 1 and two roll units R2 each having one of the paired horizontal rolls 2 and 2 are so held in the five casings that the spacing between the rolls of each pair can be adjusted.

To change rolls of the four-roll rolling mill of the prior art I, oil-pressure operating nuts 107 threadedly engaging tie rods 106 are removed, the casings 102–105 are removed from the center casing 101, and the roll units R1 and R2 are extracted from the casings 102–105, as shown in FIG. 18. Then, in case of the roll units R1, as is shown in FIG. 19, the gear coupling 111, eccentric cartridge half 112, cartridge top plate 113, lock nut 114, bearing 115, the other eccentric cartridge half 116, taper sleeve 117, and driving roll 118 are removed. It is almost the same with the roll units R2 though they have a smaller number of parts.

The above work for the four roll units takes two persons eight hours, or 16 man-hours. Accordingly, the more frequent the roll change is, the more the productivity is reduced.

Besides, to reassemble the roll units, almost the whole of the above procedure has to be followed in the reverse order, which takes a lot of man-hours. The eccentric cartridges in particular make the reassembly and adjustment complicated. Once they are removed completely from the casings, the rolling reduction has to be adjusted from scratch; i.e., from the zero adjustment of each roll unit.

In case of a three- or two-roll rolling mill too, its disassembly and reassembly take a lot of man-hours, though in a different degree, for the same reasons.

On the other hand, disclosed in the Japanese Utility Model Publication, No. 10423/H 8 (1996), is a method for adjusting the roll alignment by inserting a shim or shims (thin plates to adjust the thickness) between each roll and the housing (prior art II). By this method, however, one has to assemble the rolling mill on one's estimate, measure the slippage in the alignment, disassemble the rolling mill, change shims, and repeats this series of work until the slippage is eliminated.

Furthermore, in the adjusting device disclosed in the Japanese Unexamined Patent Application, No. 16243/H 4 (1992), (prior art III) shown in FIG. 20, two boxes 212 are so mounted on an eccentric shaft 206 that one box 212 takes its position on one side of a roll 203; the other box, on the other side. A pin 218 is inserted, in parallel with the eccentric shaft 206, in each box 212, and one end of each pin 218 is pushed against the housing 202. An operating shaft 222 is so inserted in each box 212 that the operating shaft 222 and the pin 218 form a right angle and an eccentric protrusion 221 on the tip of the operating shaft 222 engages in the recess of the pin 218. The roll 203 is aligned with the pass line by turning the two operating shafts 222 to push and pull the pins 218 and thereby moving the two boxes 212 in parallel with the eccentric shaft 206.

In case of the above prior art II, one has to repeat the disassembly, measurement, and reassembly many times, which is very labour- and time-consuming.

In case of the above prior art III, the operating shafts 222 on both sides of the roll 203 require to be manipulated not only simultaneously but also in different ways; i.e., to manipulate one shaft to pull its pin and at the same time manipulate the other to push its pin, which is troublesome. It also poses a problem that if there remains even a slight gap between the pin 218 and the housing 202 on either side, there occurs a slippage immediately.

Moreover, it is needless to say that unless all the two, or three, or four rolls are completely aligned with the pass line, the rolled bar or wire is given a section of distorted circle, and the dimensional precision is also disturbed.

In accordance with the above, it is the primary object of the present invention to provide a rolling mill which is easy and quick to change rolls and quite simple and easy to adjust its rolling reduction.

It is another object of the present invention to provide a device to adjust the alignment of a plurality of rolls with a circumferential groove easily and precisely.

Furthermore, although we already proposed a rolling mill of a split housing type wherein the roll units are held between the two housing segments, in order to reduce the necessary man-hours for the disassembly and reassembly of the rolling units, make the roll change easy, and thereby increase productivity significantly, it is more object of the present invention to provide a roll-alignment adjusting device which prevents the roll alignment from being disturbed when such a split housing has been separated, and thereby enables a simpler, easier, quicker adjustment of roll alignment.

SUMMARY OF THE INVENTION

According to the first aspect of the present invention, there is provided a rolling mill having a plurality of roll units, a rolling-reduction adjusting device of an eccentric-cartridge type to adjust the rolling reduction of the roll units, and a roll-alignment adjusting device, all mounted on its housing. The housing is split into freely separable and joinable first and second housing segments. The first housing segment has semicircular bearing-holder segments formed in its joint surface, and the second housing segment has semicircular bearing-holder segments formed in its joint surface. The shafts of the roll units are held between the first and second housing segments by being journaled in the eccentric cartridges which are fitted in the bearing holders consisting of the semicircular bearing-holder segments.

According to the second aspect of the present invention, the rolling-reduction adjusting device is provided with a driving mechanism which is mounted entirely on the first housing segment.

According to the third aspect of the present invention, any of the roll units is or are a driving roll unit or units, and the eccentric cartridges of the rolling-reduction adjusting device of the driving roll unit or units are given a configuration such that they consist each of the first and second semicircular cartridge segments. The first semicircular cartridge segment is fitted in the semicircular bearing-holder segment of the first housing segment, and the second semicircular cartridge segment is fitted in the semicircular bearing-holder segment of the second housing segment.

According to the fourth aspect of the present invention, the shaft or shafts of the driving roll unit or units by the third aspect of the present invention is or are journaled in bearings which are fitted in concentric sleeves which are in turn accommodate in eccentric cartridges consisting of the first and second semicircular cartridge segments.

According to the fifth aspect of the present invention, the roll-alignment adjusting device comprises adjusting mechanisms and chucks to connect the shaft ends of the roll units to the adjusting rods of the adjusting mechanisms. Each adjusting mechanism further comprises (i) an outer nut which is fixed to the housing and has internal threads, (ii) a middle nut which has internal and external threads, the external threads engaging the internal threads of the outer nut, and is rotated externally, and (iii) an adjusting rod which has external threads to engage the internal threads of the middle nut. The first thread joint by the internal threads of the outer nut and the external threads of the middle nut and the second thread joint by the internal threads of the middle nut and the external threads of the adjusting rod are given each a thread of the opposite hand and a different pitch.

According to the sixth aspect of the present invention, the outer nut of each adjusting mechanism of the roll-alignment adjusting device is fixed to the first housing segment. The chucks of the roll-alignment adjusting device are rendered a split type, each consisting essentially of the first and second chuck segments, and the second chuck segment is freely removable from, and attachable to, the first chuck segment.

The advantage offered by the first aspect of the invention is that the roll units can easily be taken out because they are exposed by removing the second housing segment off the first housing segment, and the reassembly can easily be carried out just by following the same procedure in the reverse order; therefore, the necessary man-hours for the disassembly and reassembly are reduced.

The advantage offered by the second aspect of the invention is that because the driving mechanism of the rolling-reduction adjusting device remains intact on the first housing segment and fan-shaped gears constituting the rolling-reduction adjusting device stay on the first housing segment even when the second housing segment is removed, the set value of rolling reduction is not disturbed and the zero adjustment is also unnecessary. Only a fine adjustment is required; therefore, the readjustment after the reassembly can be carried out very easily.

The advantage offered by the third aspect of the invention is that because the first semicircular cartridge segments remain on the first housing segment and the second semicircular cartridge segments go with the second housing segment when the second housing segment is removed, the disassembly thereafter and the reassembly can easily be carried out.

The advantage offered by the fourth aspect of the invention is that it suffices for the assembly to just fit the concentric sleeves of each roll unit in the eccentric cartridges. It is unnecessary to align the roll units to their eccentric cartridges; therefore, the necessary man-hours for the assembly are reduced.

The advantage offered by the fifth aspect of the invention is that the adjusting rod can be moved minutely by turning the middle nut because the first and second thread joints are each given a thread of the opposite hand and a different pitch; therefore, fine adjustment of the roll alignment can easily be carried out.

The advantage offered by she sixth aspect of the invention is that the roll units can be taken out by removing only the second housing segment and the second chuck segments. Besides, because the adjusting mechanisms remain intact on the first housing segment when the second housing segment is removed, only a fine adjustment is required during the reassembly; therefore, the roll alignment can be adjusted very easily.

BRIEF DESCRIPTION OF THE DRAWINGS

The features and advantages of the present invention will become more clearly appreciated from the following description in conjunction with the accompanying drawings, in which.

DETAILED DESCRIPTION OF THE PREFERRED EMBODIMENTS

A preferred embodiment of the present invention applied to a four-roll rolling mill is now described with reference to the drawings.

Figure 1:
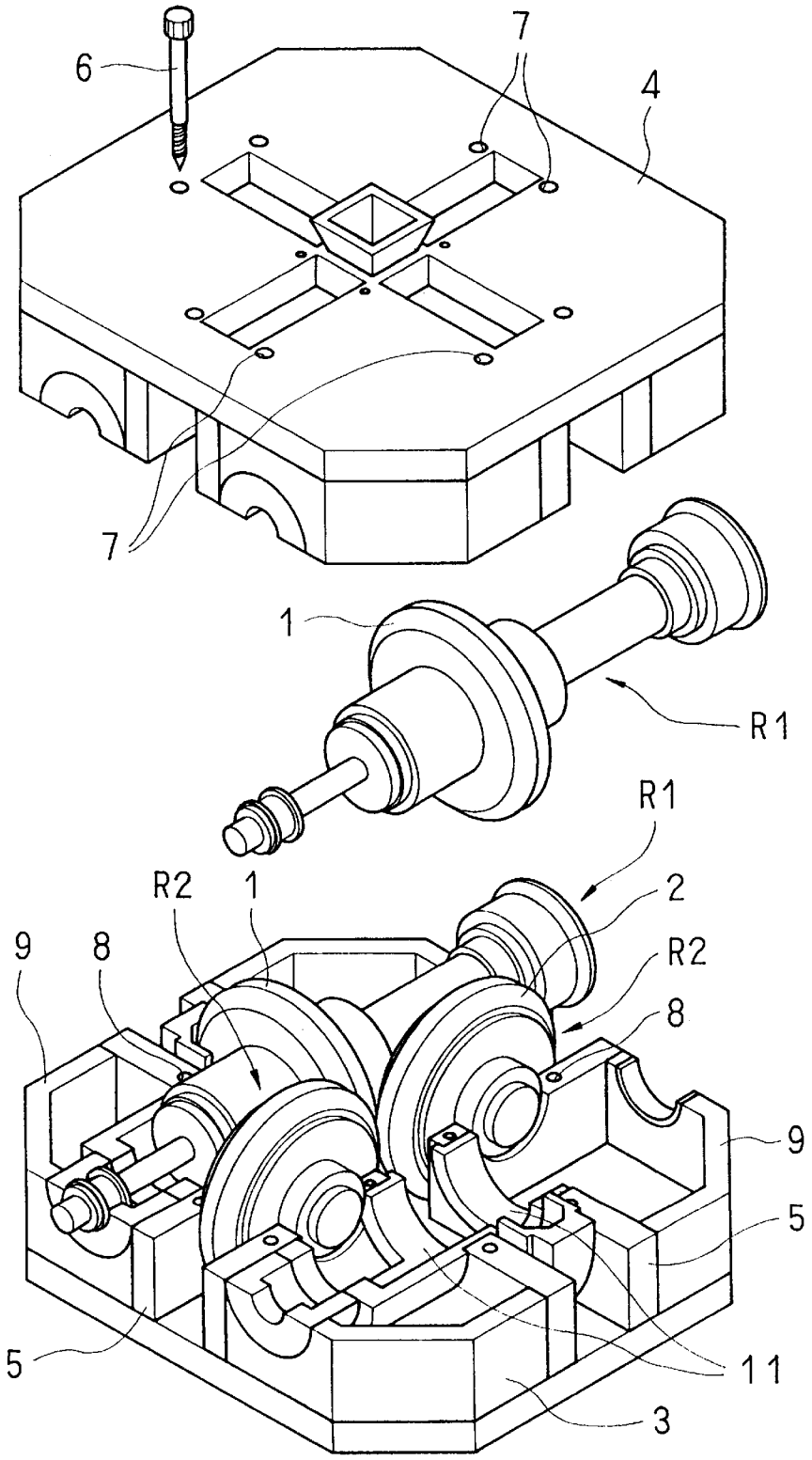
FIG. 1 is an exploded perspective view of one embodiment of a four-roll rolling mill of the present invention.
Figure 2:
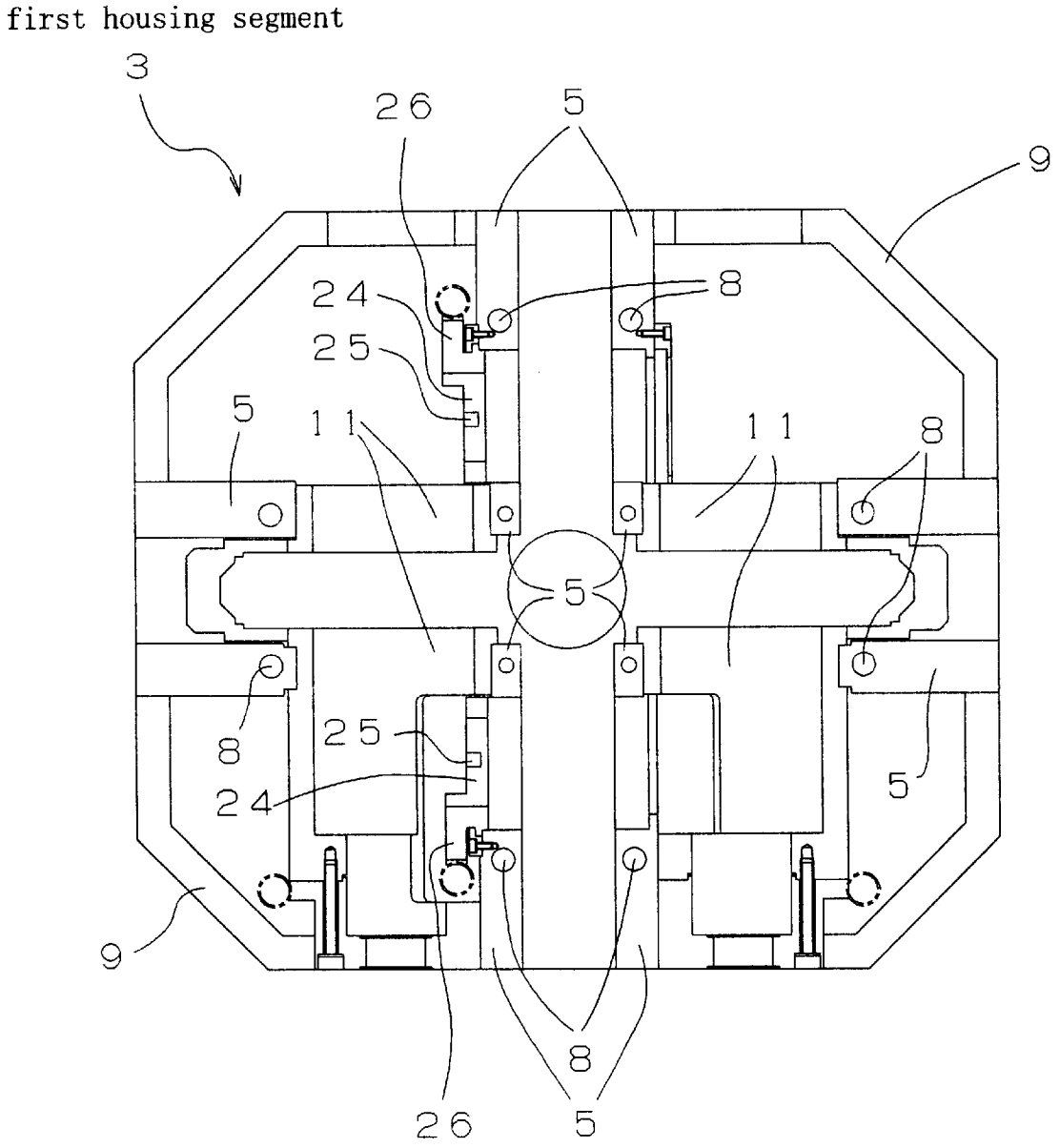
FIG. 2 is a top view of the first housing segment 3 of FIG. 1, from which the roll units R1 and R2 are removed.
Figure 3:
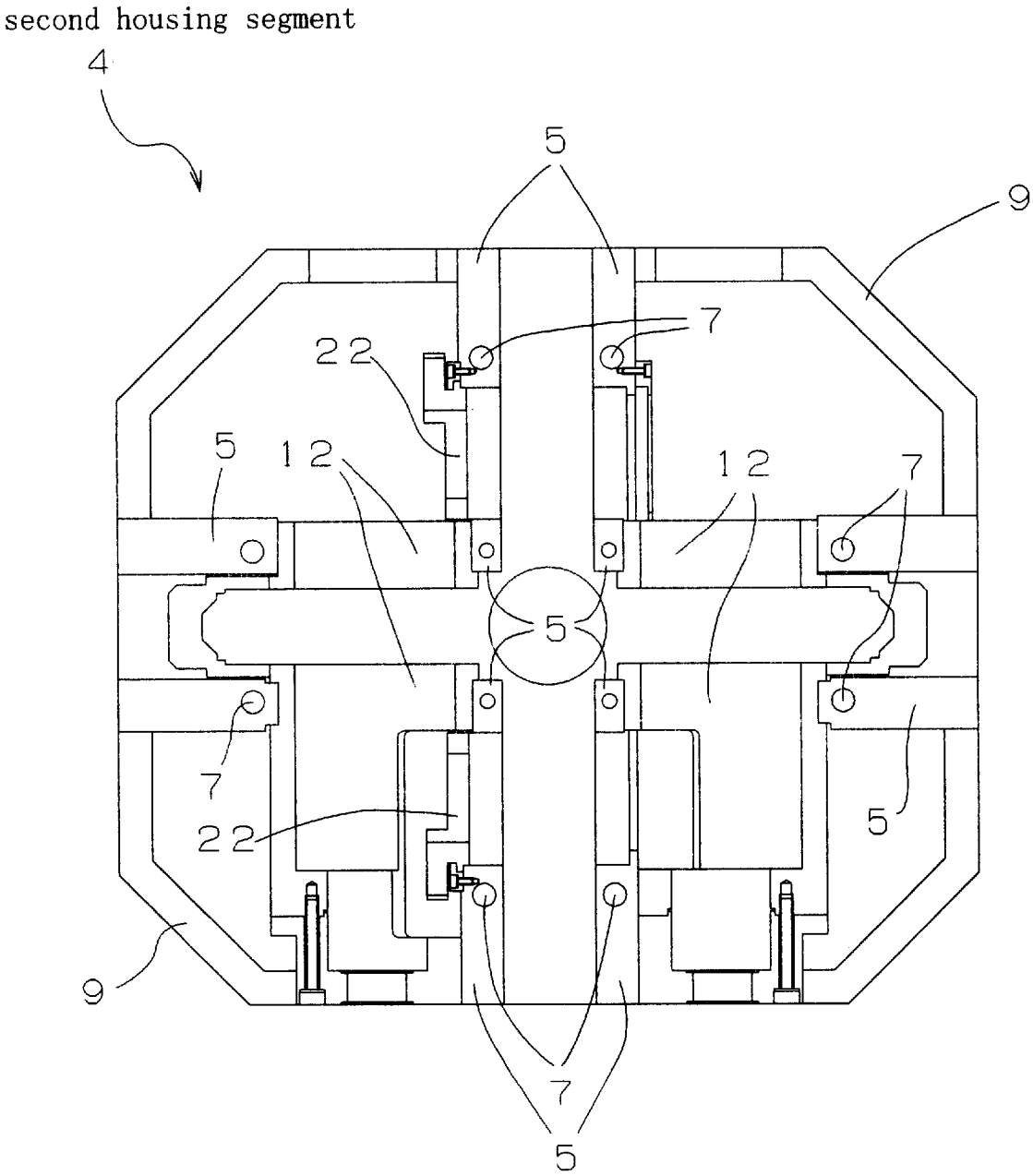
FIG. 3 is a bottom view of the second housing segment 4 of FIG. 1.

In FIGS. 1–3, the numeral 3 designates the first housing segment; 4, the second housing segment. The two housing segments 3 and 4 constitute a split housing. Namely, when the first and second housing segments 3 and 4 are joined together and tightened by tie bolts 6, four roll units R1 and R2 are so held in the housing that they can rotate freely and are ready for rolling.

More particularly, the first and second housing segments 3 and 4 have through holes 7 and threaded holes 8 formed in their inner ribs 5, for the tie bolts 6 to join the second housing segment 4 to the first housing segment 3, or they have through holes for tie bolts to be inserted and for oil-pressure operating nuts or the likes on both sides of the tie bolts to join the housing segments.

The top surfaces of the inner ribs 5 and the peripheral ribs 9 of the first and second housing segments 3 and 4 are formed as the joint surfaces. Bearing holders, each split into two semicircular segments, to hold the four roll units R1 and R2 are formed in the inner ribs 5 at suitable places.

In case of known rolling-reduction adjusting devices, the eccentric cartridges are one-piece sleeves and fitted into holes formed in the housing. However, the eccentric cartridges of the roll units R1 of the present invention are split cartridges, each split in the radial direction into two segments. The eccentric cartridges of the roll units R2 are one-piece sleeves.

As shown in FIG. 2, the first cartridge segments 11 of the split eccentric cartridges which constitute the rolling-reduction adjusting device of the roll units R1 are fitted in the bearing holder segments of the first housing segment 3. On the other hand, as shown in FIG. 3, the second cartridge segments 12 are fitted in the bearing holder segments of the second housing segment 4.

When the first and second cartridge segments 11 and 12 of each pair are coupled, they constitute a sleeve of which the hole is eccentric and the wall thickness changes gradually in the circumferential direction. The first cartridge segment 11 of the eccentric cartridge is so fitted into the bearing holder segment of the first housing segment 3 that it can turn in the bearing holder segment. The second cartridge segment 12 is also so fitted into the bearing holder segment of the second housing segment 4 that it can turn in the bearing holder segment. Accordingly, when the first cartridge segment 11 turns in the bearing holder, or the two bearing holder segments coupled, the second cartridge segment 12 is pushed and turned; thus, they function as an eccentric cartridge. Therefore, when the shafts of the roll units R1 are journaled in the eccentric cartridges (each consisting of the first and second cartridge segments 11 and 12) and the eccentric cartridges are turned, the centers of the shafts of the roll units R1 do orbital motion, causing the spacing between the paired driving rolls 1 and 1 to increase and decrease. Thus, the rolling reduction can be adjusted.

As described above, the eccentric cartridges of the roll units R1 of the driving rolls 1 and 1 consist each of the first cartridge segment 11 and the second cartridge segment 12, and these two cartridge segments 11 and 12 have essentially the same construction but a difference that the first cartridge segment 11 has a fan-shaped gear to receive driving torque, whereas the second cartridge segment 12 does not, as described later.

Figure 6:
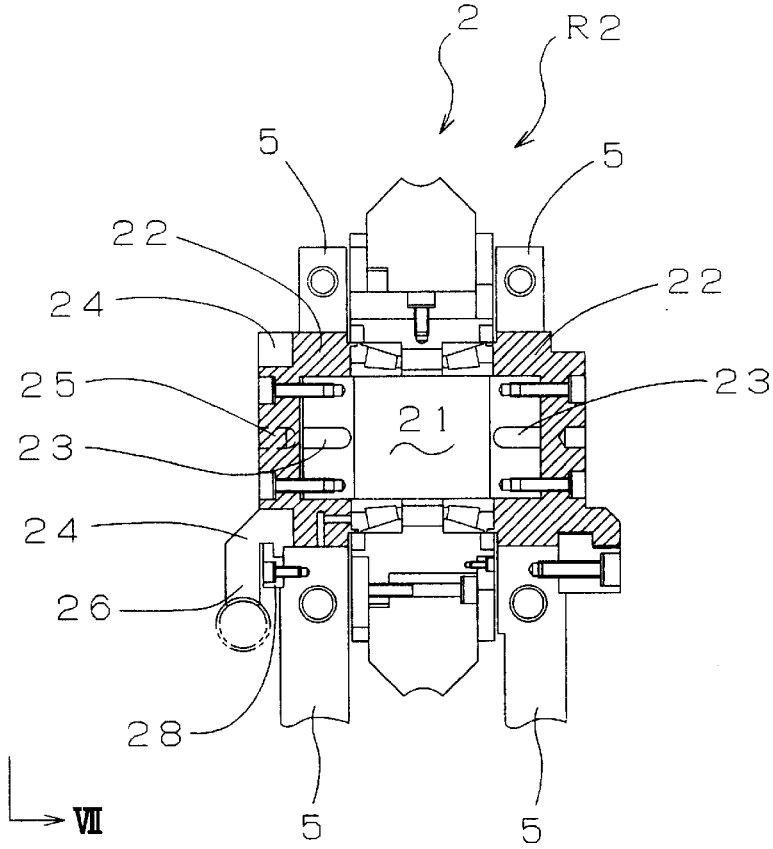
FIG. 6 is a partially cutaway top view of a roll unit R2 built in the first housing segment 3.
Figure 7:
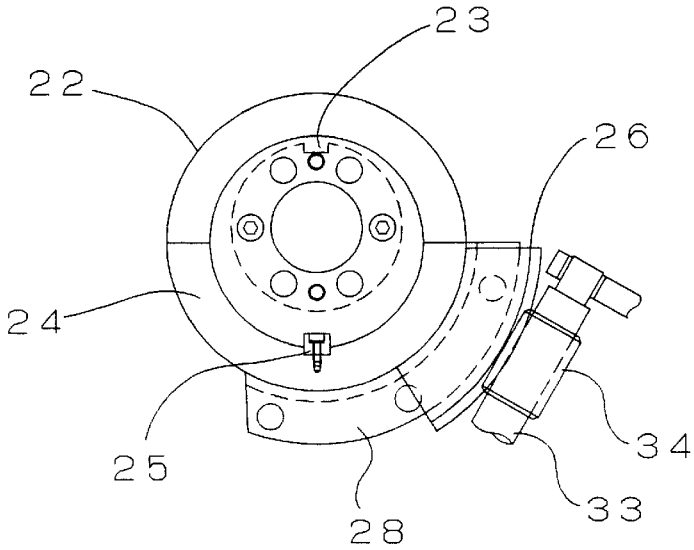
FIG. 7 is a view of a roll unit R2 built in the first housing segment 3 as seen in the direction of the arrow VII in FIG. 6.

As shown in FIGS. 6 and 7, the eccentric cartridges of the roll unit R2 of each idle roll 2 comprise two sleeves 22 which are so fitted onto both ends of the shaft 21 of the idle roll 2 that the shaft 21 is journaled in the sleeves 22 eccentrically. The relative turn between the shaft 21 and the sleeves 22 is prohibited by keys 23.

As shown in FIGS. 2, 6 and 7, the sleeve 22 on one end of the shaft 21 is fitted in a semicircular member 24 which is rotatably supported in the first housing segment 3, and a key 25 driven into the joint between the sleeve 22 and the semicircular member 24 prohibits the relative turn between the sleeve 22 and the semicircular member 24 and fixes the relative positional relation among the shaft 21, sleeve 22, and semicircular member 24. A fan-shaped gear 26 is mounted on the semicircular member 24. The part 28 is the holder of the semicircular member 24 and fixed to the first housing segment 3.

Then, the sleeve 22 is journaled in a split bearing holder consisting of two segments formed in the first and second housing segments 3 and 4, and also fitted into the semicircular member 24 which is rotatably supported in the first housing segment 3. Thus, the sleeve 22 functions as an eccentric cartridge when it is turned as a unit with the shaft 21.

Figure 4:
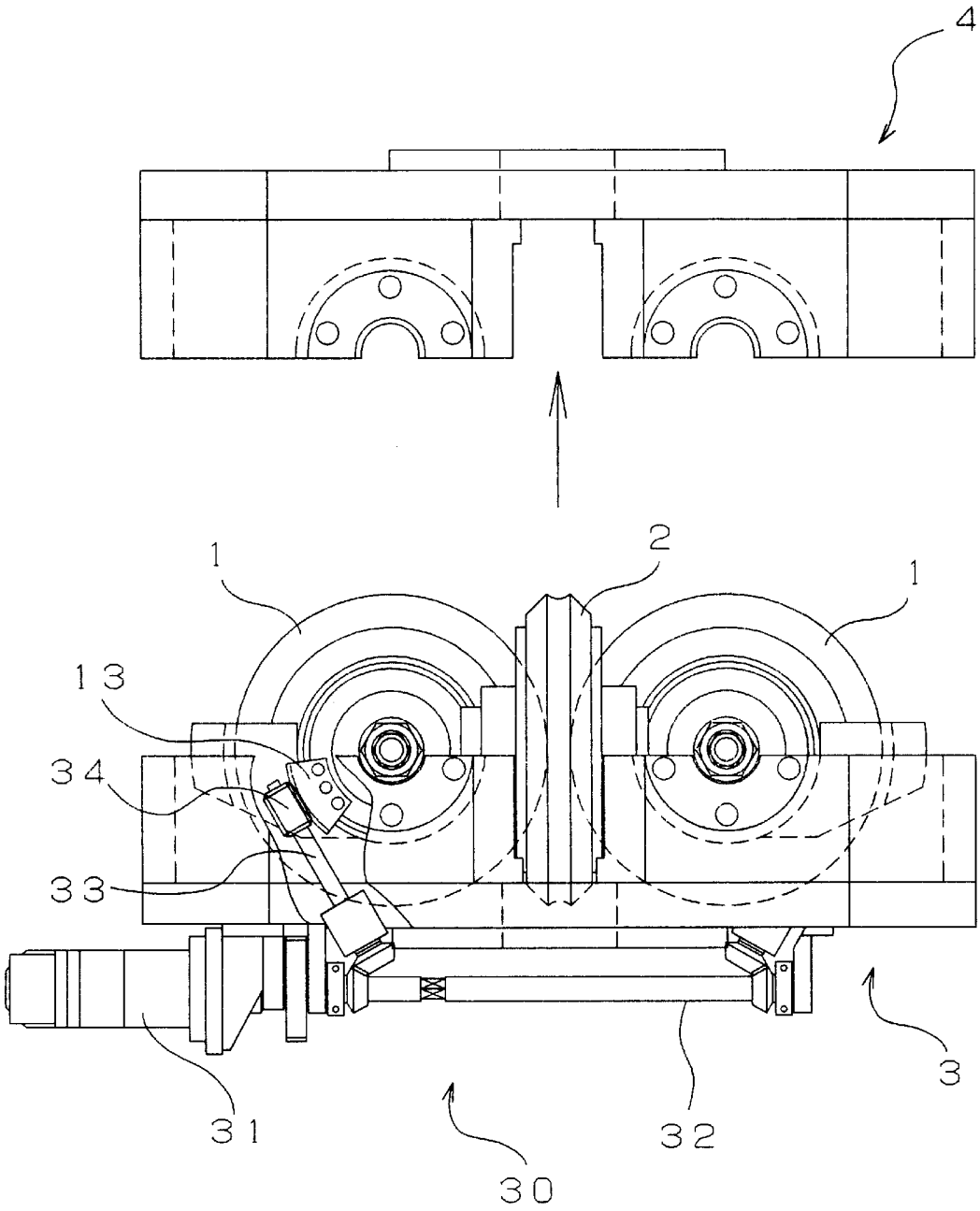
FIG. 4 is an exploded side view of the rolling mill of FIG. 1.

FIG. 4 shows the first and second housing segments 3 and 4 separated from each other. A driving mechanism 30 of the rolling-reduction adjusting device of the driving rolls 1 and 1, comprising a motor 31, a transmission shaft 32, drive shafts 33, worm gears 34, and so on, is entirely mounted on the first housing segment 3. A driving mechanism of the rolling-reduction adjusting device of the idle rolls 2 and 2 is also mounted on the first housing segment 3, though not shown in FIG. 4.

Figure 5:
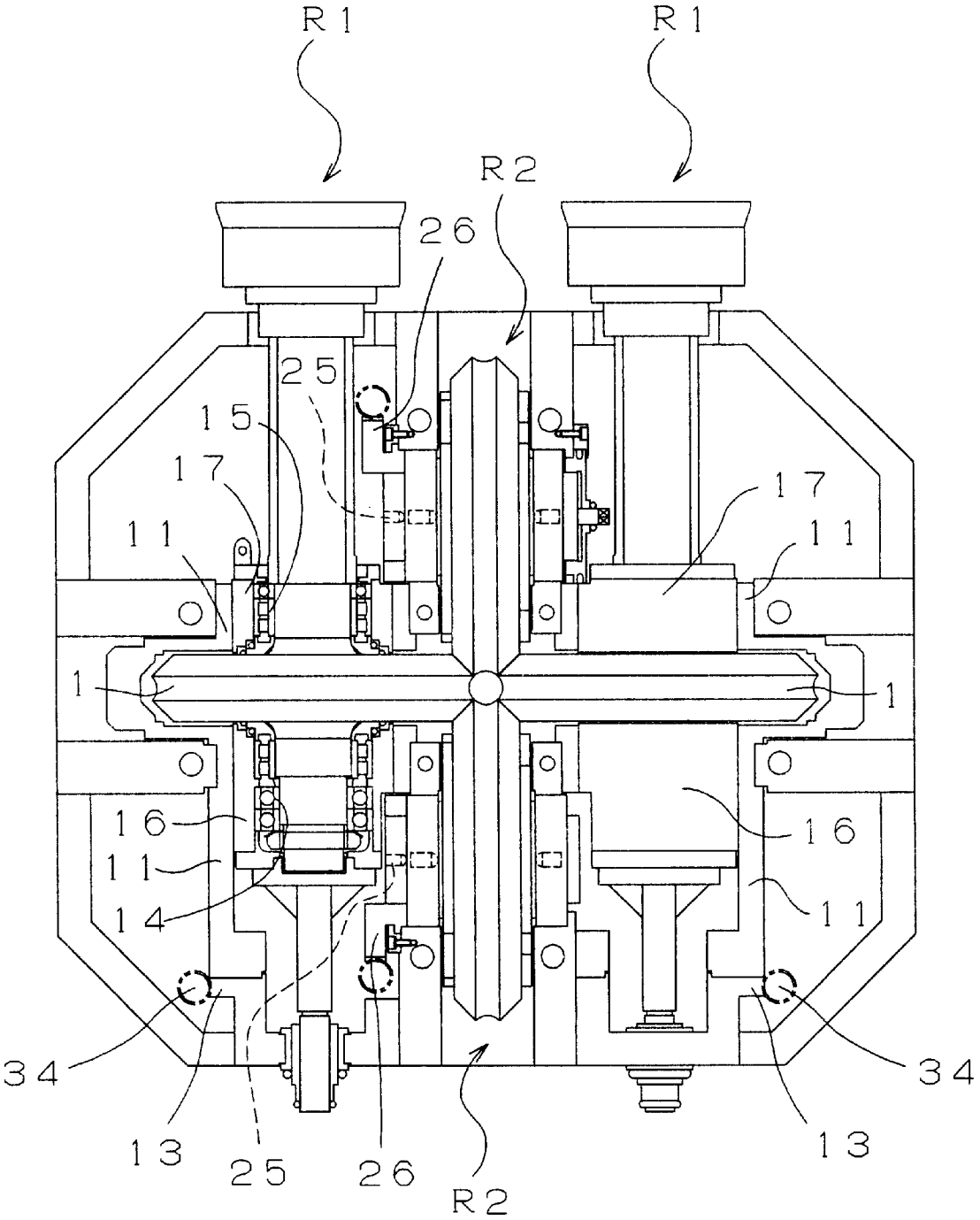
FIG. 5 is a top view of the first housing segment 3 with the roll units R1 and R2.

As shown in FIG. 5, the fan-shaped gears 13 and 26 to receive the torque and turn the eccentric cartridges of the roll units R1 and R2 are mounted on the first cartridge segments 11 and the semicircular members 24.

Accordingly, when the motor 31 rotates, the first cartridge segments 11 are turned by the motor 31 through the transmission shaft 32, drive shafts 33, worm gears 34, and fan-shaped gears 13, pushing and turning the second cartridge segments 12 in the bearing holders in the housing consisting of the first and second housing segments 3 and 4. Thus, the rolling reduction of the pair of driving rolls 1 and 1 can be adjusted. In the same way, when the semicircular members 24 are turned through the fan-shaped gears 26 by the driving mechanism mounted on the first housing segment 3, the sleeves 22 are turned. Thus, the rolling reduction of the idle rolls 2 and 2 can be adjusted.

Figure 8:
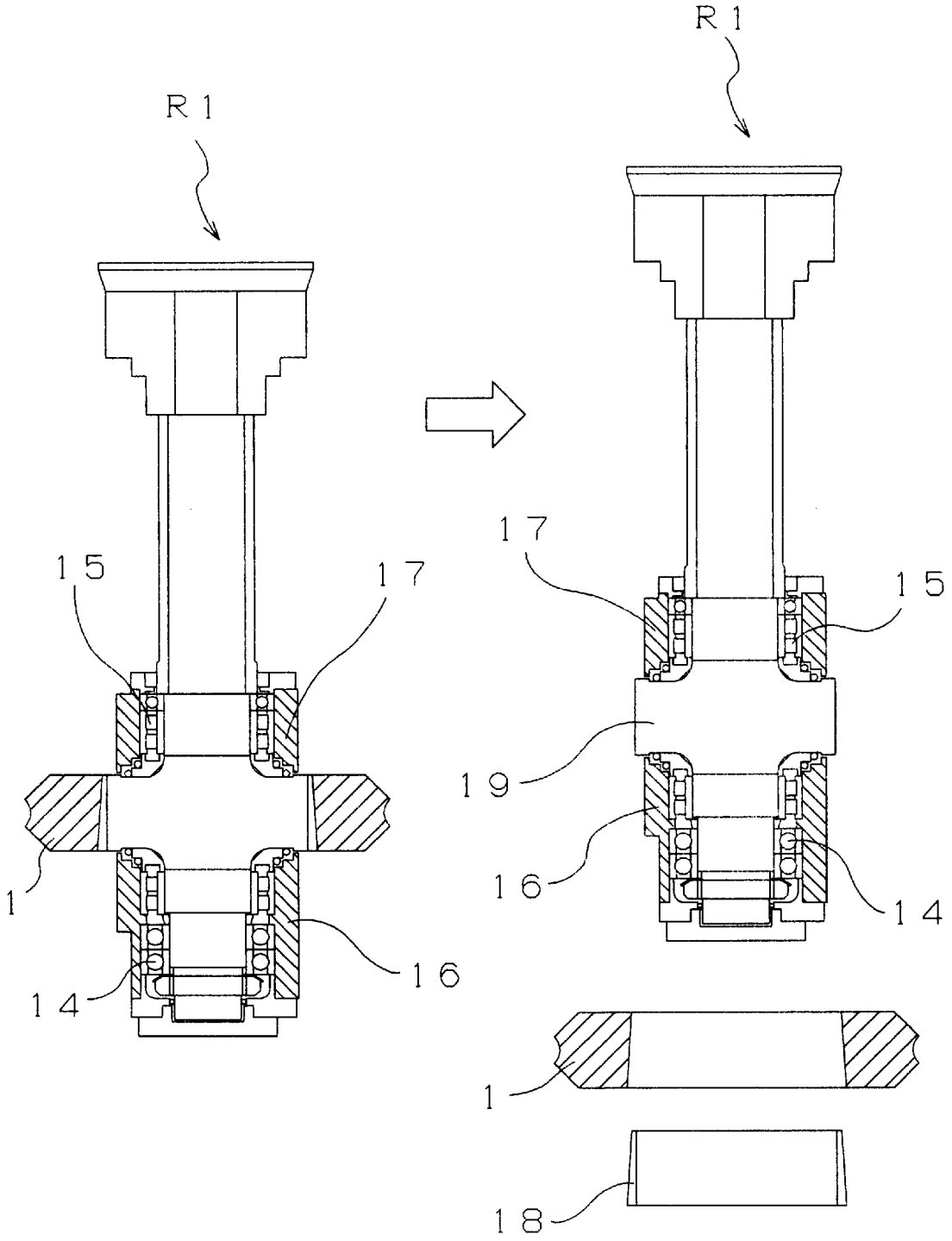
FIG. 8 is an illustration of the assembly and disassembly of a driving roll unit R1.

In case of the roll units R1, as is shown in FIG. 8, bearings 14 and 15 are fitted, at both sides of the driving roll 1, on the shaft of each roll unit R1, and fitted on these bearings 14 and 15 are sleeves 16 and 17, respectively. The inner and outer circles of the cross section of either sleeve are concentric and its wall thickness is even around.

To assemble the rolling mill as is shown in FIG. 5, each roll unit R1 is set in the first housing segment 3, the sleeves 16 and 17 fitted in the first cartridge segments 11. Each roll unit R2 is set in the first housing segment 3, the sleeves 22 fitted in the bearing holder segments. The second housing segment 4 is joined to the first housing segment 3, the second cartridge segments 12 fitted on the sleeves 16 and 17, the bearing holder segments fitted on the sleeves 22, the roll units R1 and R2 held down in their positions. Then, the first and second housing segments 3 and 4 are tightly joined by bolts and nuts.

To take out the roll units, the second housing segment 4 is removed from the first housing segment 3, the second cartridge segments 12 going with the second housing segment 4, the roll units R1 and R2 exposed. When a roll unit R1 is taken out, the sleeves 16 and 17 part from the first cartridge segments 11 and the first cartridge segments 11 are left on the first housing segment 3. When a roll unit R2 is taken out, the sleeves 22 (eccentric cartridges) on both ends of the shaft 21 part from the bearing holder segments of the housing segment 3.

As described above, the motor 31, transmission shaft 32, drive shafts 33, worm gears 34, fan-shaped gears 13, and first cartridge segments 11, which constitute the rolling-reduction adjusting device, are all mounted on the first housing segment 3, but not on the second housing segment 4. Consequently, as is shown in FIG. 4, even when the second housing segment 4 is removed, the four roll units R1 and R2 are not exposed to slippage but remain in their base positions in the eccentric cartridges, and hence the zero adjustment of each roll unit and the phase adjustment among the four spots are unnecessary. Accordingly, when the rolling mill is reassembled, the adjustment of the rolling reduction can be finished only with such a fine adjustment as compensate the wear of the rolls. Thus, the rolling reduction can be adjusted simply and easily.

Regarding the roll units R2 of the idle rolls 2 and 2, the driving mechanism of the rolling-reduction adjusting device is all mounted on the first housing segment 3, and prohibited by each key 25 are the relative turn and positional slippage between the semicircular member 24 with the fan-shaped gear 26 constituting the drive mechanism and the sleeve 22 constituting the eccentric cartridge. Therefore, in the same way as the roll units R1, the rolling reduction can be adjusted simply and easily.

FIG. 8 shows a roll unit R1 taken out during the disassembly of the rolling mill. In case of the roll change, the roll 1 can be removed off the roll shaft 19 just by extracting a taper sleeve 18. Because the bearings 14 and 15 remain in the sleeves 16 and 17 during the roll change, troublesome work is reduced extremely and the necessary man-hours for the disassembly and reassembly are reduced significantly.

Figure 9:
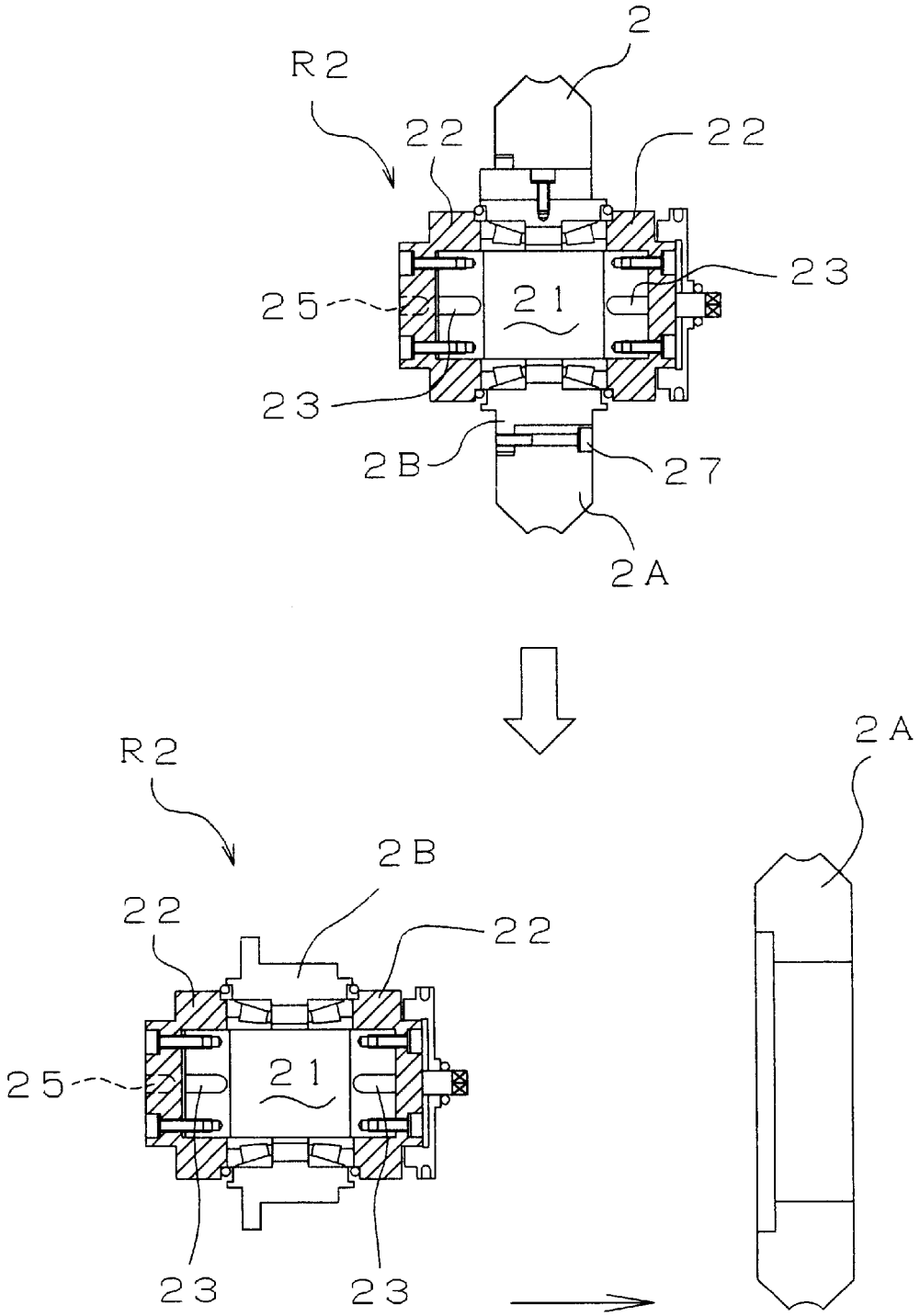
FIG. 9 is an illustration of the assembly and disassembly of an idle roll unit R2.

FIG. 9 shows a roll unit R2 taken out during the disassembly of the rolling mill. In case of the roll change, the roll 2 can be removed just by removing a bolt 27 and removing the main portion 2A off the boss portion 2B. Thus, troublesome work is reduced extremely and the necessary man-hours for the disassembly and reassembly are reduced significantly.

Although the embodiment described above is concerned with a four-roll rolling mill, the present invention can also be applied to three- and two-roll rolling mills. In these application too, the invention offers the same advantage that the necessary man-hours for the disassembly and reassembly are reduced significantly and the rolling reduction can be adjusted simply, easily, and quickly.

With reference to drawings, a preferred embodiment of a roll-alignment adjusting device of the present invention will now be described.

In the first place, a rolling mill which the roll-alignment adjusting device is applied to will be described.

Figure 13:
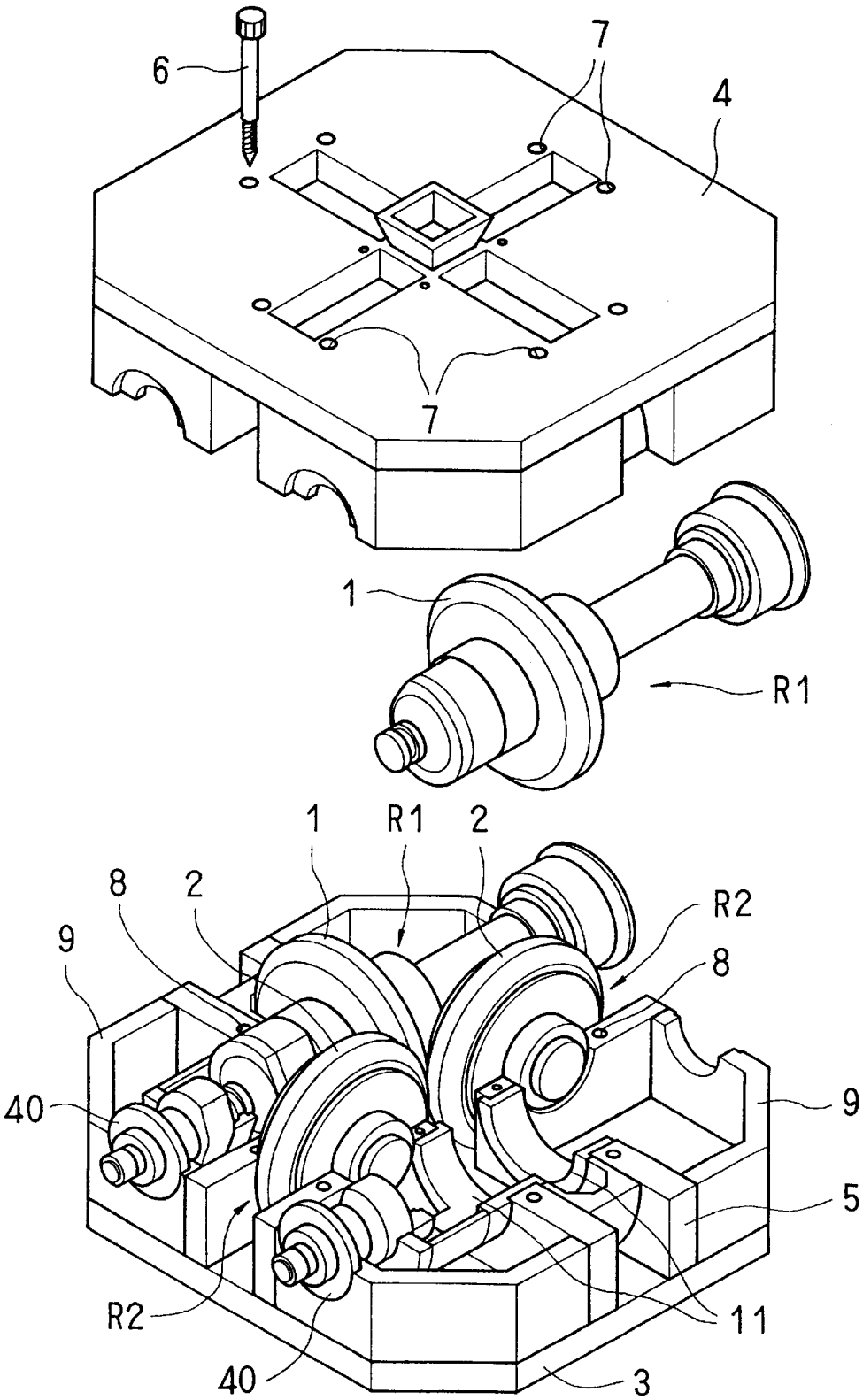
FIG. 13 is an exploded perspective view of a four-roll rolling mill with a split housing in which the roll-alignment adjusting devices of FIG. 10 are built.
Figure 14:
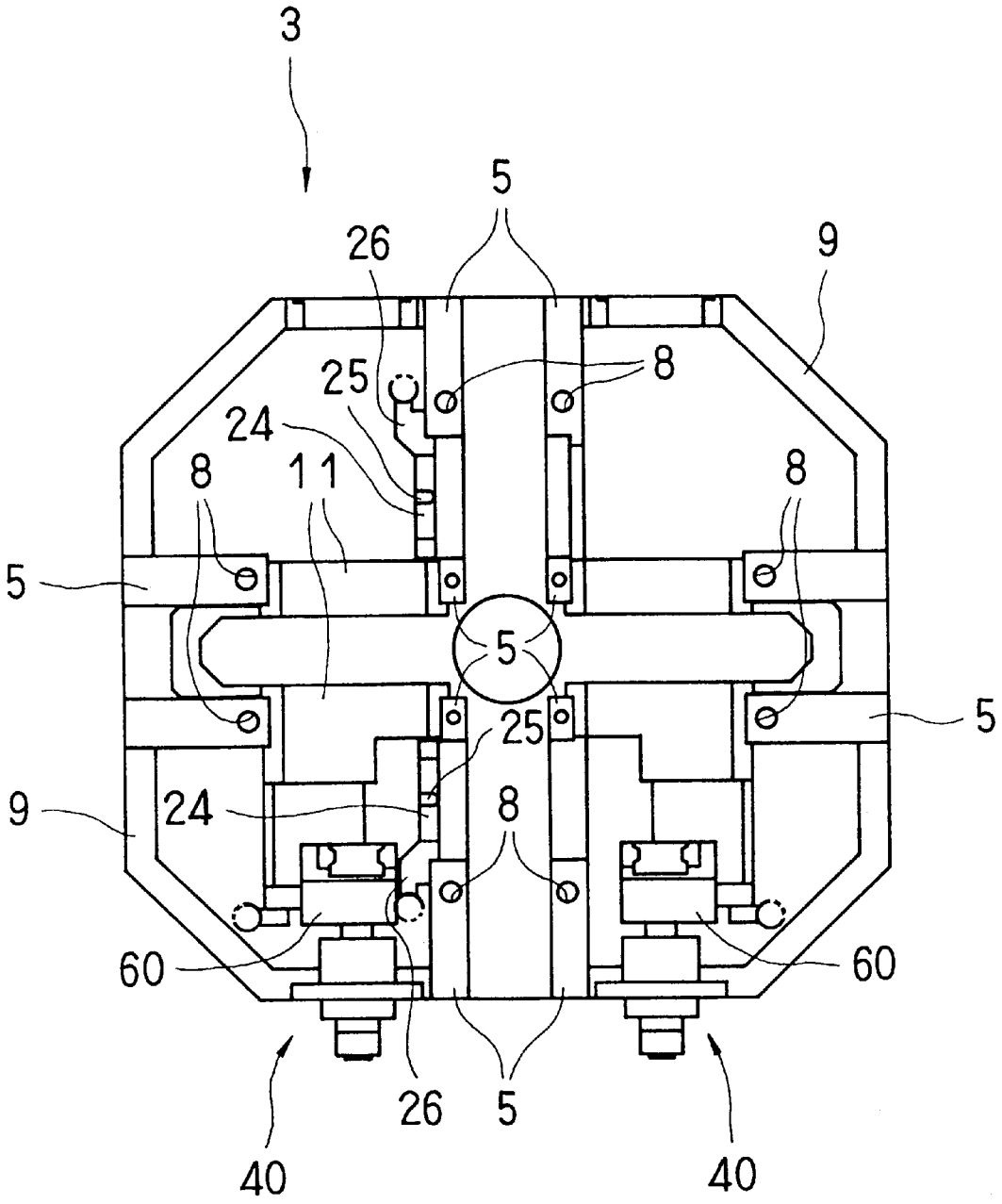
FIG. 14 is an top view of the first housing segment 3 of FIG. 13, from which the roll units R1 and R2 are removed.
Figure 15:
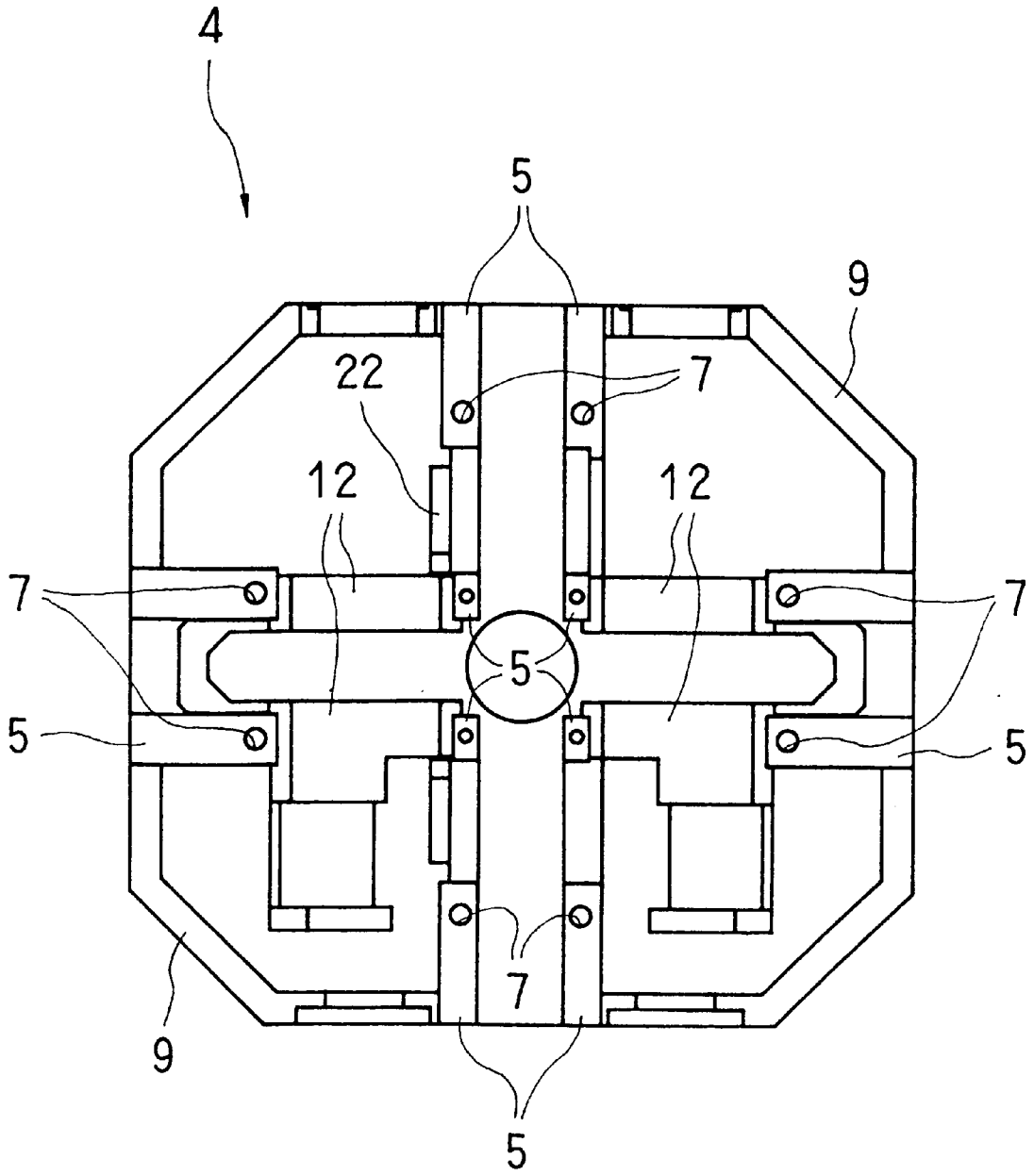
FIG. 15 is a bottom view of the second housing segment 4 of FIG. 13.

In FIGS. 13–15, the numeral 3 designates the first housing segment; 4, the second housing segment. The two housing segments 3 and 4 constitute a split housing. Namely, when the first and second housing segments 3 and 4 are joined together and tightened by tie bolts 6, four roll units R1 and R2 are so held in the housing that they can rotate freely and are ready for rolling.

More particularly, the first and second housing segments 3 and 4 have through holes 7 and threaded holes 8 formed in their inner ribs 5, for the tie bolts 6 to join the second housing segment 4 to the first housing segment 3, or they have through holes for tie bolts to be inserted and for oil-pressure operating nuts or the likes on both sides of the tie bolts to join the housing segments.

The top surfaces of the inner ribs 5 and the peripheral ribs 9 of the first and second housing segments 3 and 4 are formed as the joint surfaces. Bearing holders, each split into two semicircular segments, to hold the four roll units R1 and R2 are formed in the inner ribs 5 at suitable places.

In case of known rolling-reduction adjusting devices, the eccentric cartridges are one-piece sleeves and fitted into holes formed in the housing. However, the eccentric cartridges of the roll units R1 of the present invention are split cartridges, each split in the radial direction into two segments. The eccentric cartridges of the roll unit R2 are one-piece sleeves.

As shown in FIG. 14, the first cartridge segments 11 of the split eccentric cartridges which constitute the rolling-reduction adjusting device of the roll units R1 are fitted in the bearing holder segments of the first housing segment 3. On the other hand, as shown in FIG. 15, the second cartridge segments 12 are fitted in the bearing holder segments of the second housing segment 4.

When the first and second cartridge segments 11 and 12 of each pair are coupled, they constitute a sleeve of which the hole is eccentric and the wall thickness changes gradually in the circumferential direction. The first cartridge segment 11 of the eccentric cartridge is so fitted into the bearing holder segment of the first housing segment 3 that it can turn in the bearing holder segment. The second cartridge segment 12 is also so fitted into the bearing holder segment of the second housing segment 4 that it can turn in the bearing holder segment. Accordingly, when the first cartridge segment 11 turns in the bearing holder, or the two bearing holder segments coupled, the second cartridge segment 12 is pushed and turned; thus, they function as an eccentric cartridge. Therefore, when the shafts of the roll units R1 are journaled in the eccentric cartridges (each consisting of the first and second cartridge segments 11 and 12) and the eccentric cartridges are turned, the centers of the shafts of the roll units R1 do orbital motion, causing the spacing between the paired driving rolls 1 and 1 to increase and decrease. Thus, the rolling reduction can be adjusted.

As described above, the eccentric cartridges of the roll units R1 of the driving rolls 1 and 1 consist each of the first cartridge segment 11 and the second cartridge segment 12, and these two cartridge segments 11 and 12 have essentially the same construction but a difference that the first cartridge segment 11 has a fan-shaped gear to receive driving torque, whereas the second cartridge segment 12 does not, as described later.

The eccentric cartridges (not shown) of the roll unit R2 of each idle roll 2 comprise two eccentric sleeves which are so fitted onto both ends of the shaft of the idle roll 2 that the shaft is journaled in the eccentric sleeves eccentrically.

As shown in FIG. 14, the eccentric sleeve on one end of the shaft is fitted in a semicircular member 24 which is rotatably supported in the first housing segment 3, and a key 25 driven into the joint between the eccentric sleeve and the semicircular member 24 prohibits the relative turn between the eccentric sleeve and the semicircular member 24 and fixes the relative positional relation among the shaft, eccentric sleeve, and semicircular member 24. A fan-shaped gear 26 is mounted on the semicircular member 24.

Then, each eccentric sleeve is journaled in a split bearing holder consisting of two segments formed in the first and second housing segments 3 and 4. Therefore, each sleeve functions as an eccentric cartridge when it is turned as a unit with the shaft.

Figure 16:
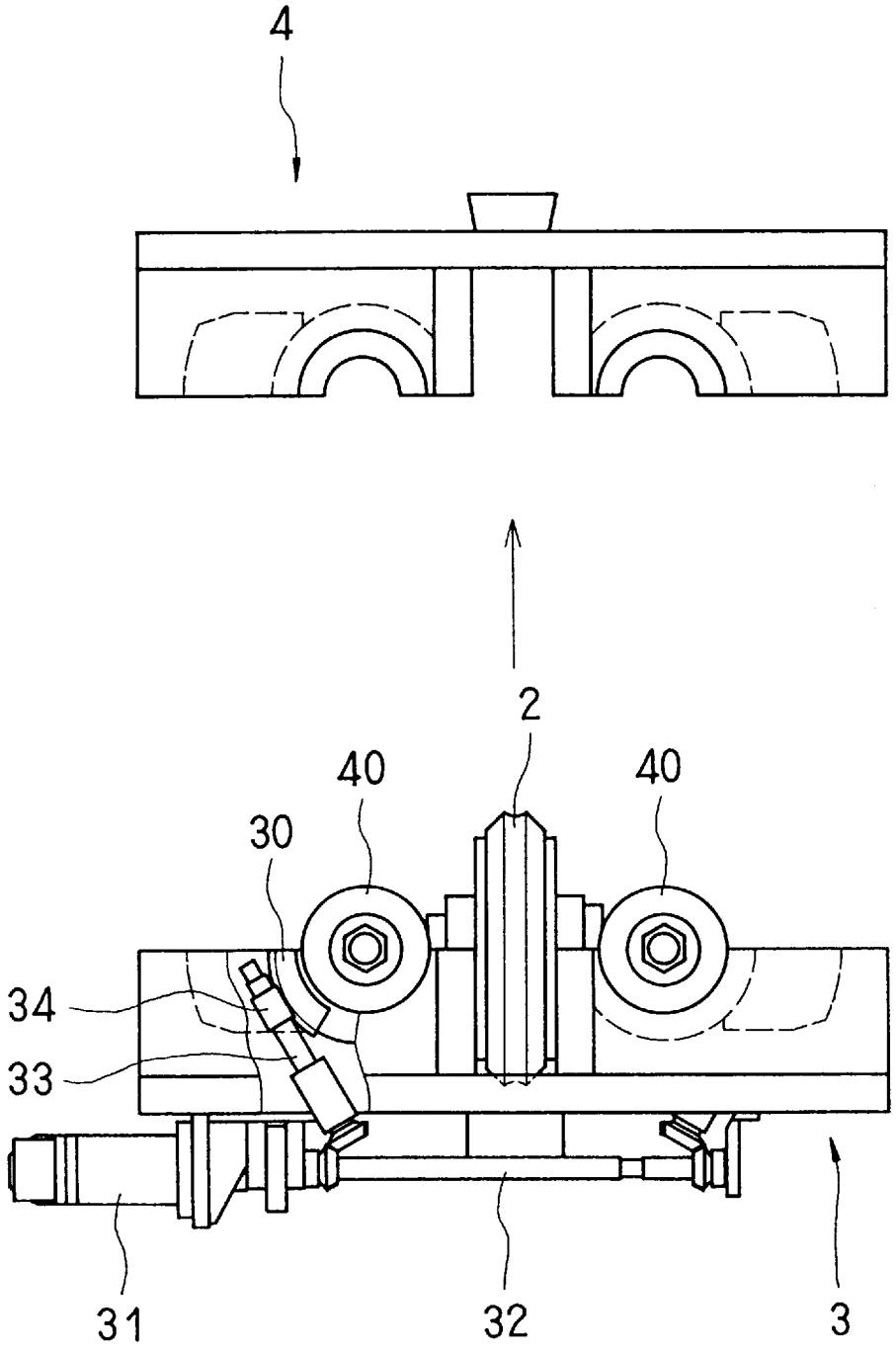
FIG. 16 is an exploded side view of the split housing of FIG. 13.

FIG. 16 shows the first and second housing segments separated from each other. A driving mechanism 30 of the rolling-reduction adjusting device of the driving rolls 1 and 1, comprising a motor 31, a transmission shaft 32, drive shafts 33, worm gears 34, and so on, is entirely mounted on the first housing segment 3. A driving mechanism of the rolling-reduction adjusting device of the idle rolls 2 and 2 is also mounted on the first housing segment 3, though not shown in FIG. 16.

Figure 17:
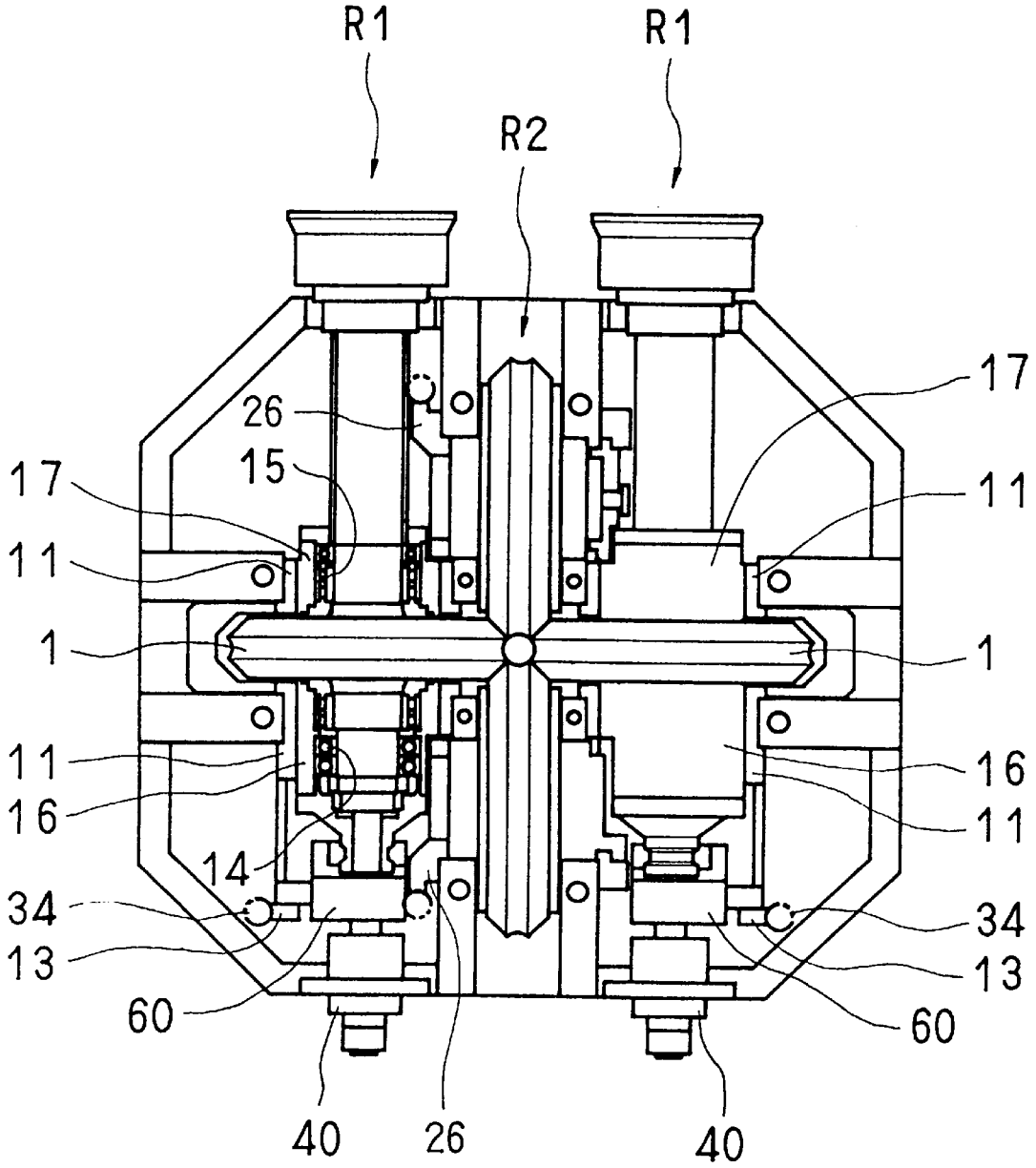
FIG. 17 is a top view of the first housing segment 3 of FIG. 13, in which the roll units R1 and R2 are built.
Figure 18:
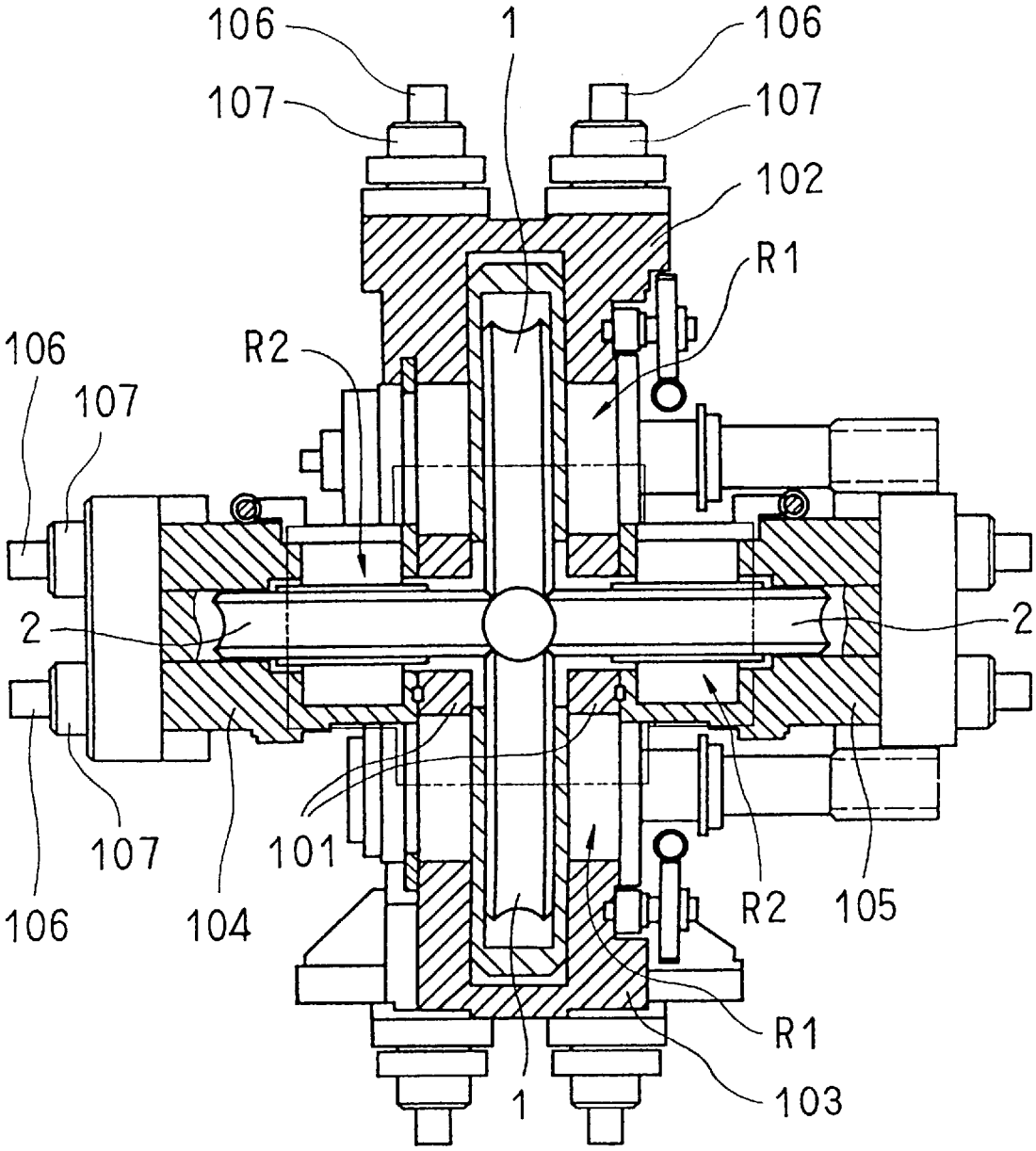
FIG. 18 Prior Art
FIG. 18 is a partially cutaway, vertical view of a conventional rolling mill.
Figure 19:
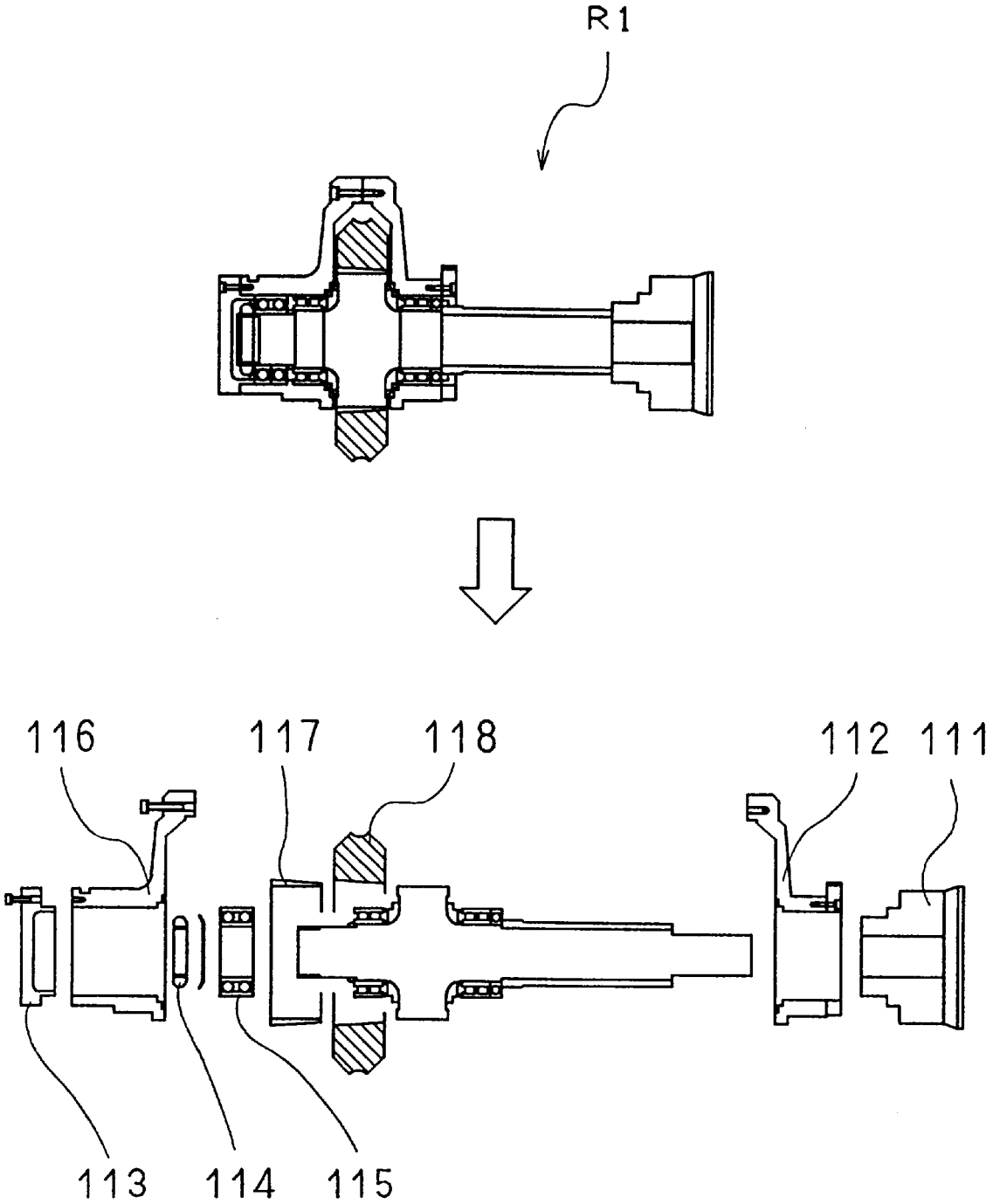
FIG. 19 Prior Art
FIG. 19 is an illustration of the assembly and disassembly of a roll unit R1 of FIG. 18.
Figure 20:
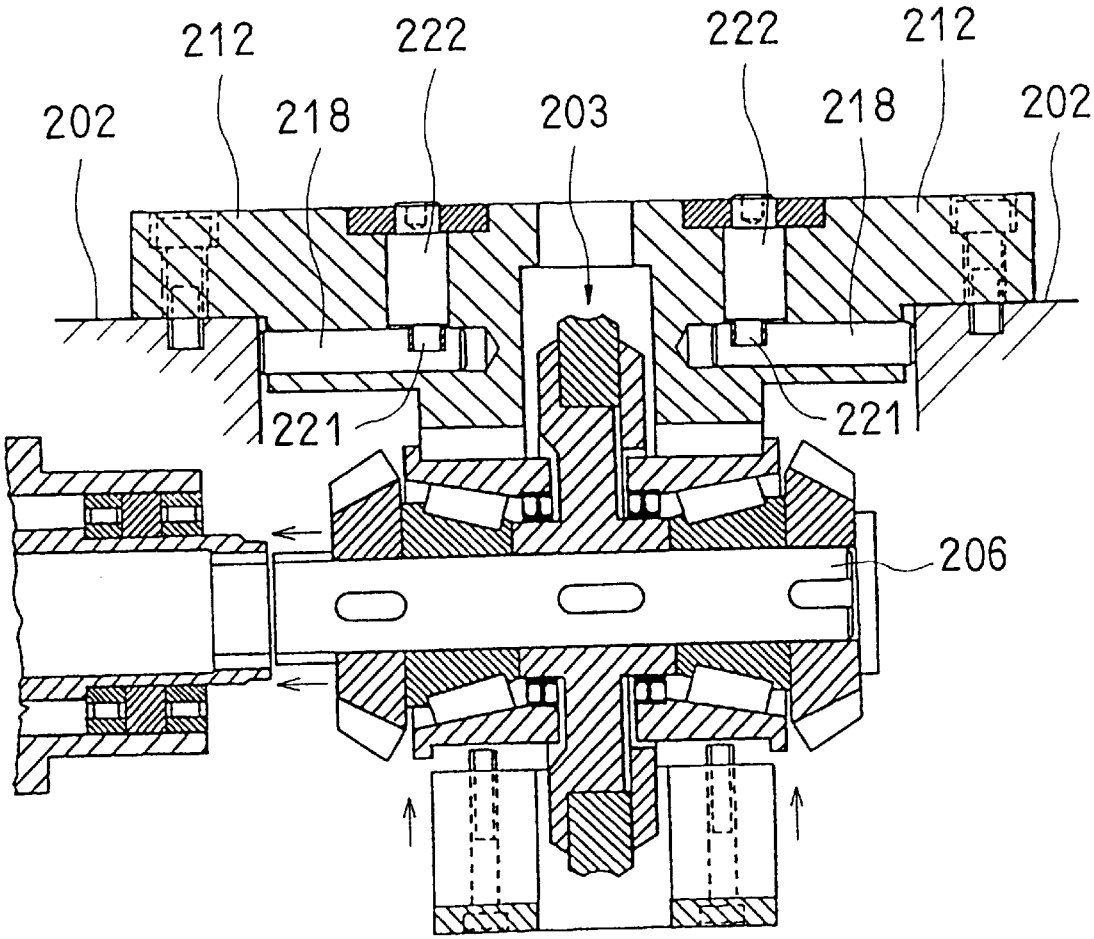
FIG. 20 Prior Art
FIG. 20 is a sectional view of a conventional roll-alignment adjusting device.

As shown in FIG. 17, the fan-shaped gears 13 and 26 to receive the torque and turn the eccentric cartridges of the roll units R1 and R2 are mounted on the first cartridge segments 11 and the semicircular members 24.

Accordingly, when the motor 31 rotates, the first cartridge segments 11 are turned by the motor 31 through the transmission shaft 32, drive shafts 33, worm gears 34, and fan-shaped gears 13, pushing and turning the second cartridge segments 12 in the bearing holders in the housing consisting of the first and second housing segments 3 and 4. Thus, the rolling reduction of the pair of driving rolls 1 and 1 can be adjusted. In the same way, when the semicircular members 24 are turned through the fan-shaped gears 26 by the driving mechanism mounted on the first housing segment 3, the eccentric sleeves are turned. Thus, the rolling reduction of the idle rolls 2 and 2 can be adjusted.

As described above, the rolling mill of the present embodiment has the feature that the roll units R1 and R2 can easily be taken out by dividing the split housing into the first and second housing segments 3 and 4, as shown in FIG. 16, and the roll units R1 and R2 can be built in the split housing just by fitting them in the first housing segment 3 and joining the second housing segment 4 onto the first housing segment 3; thus, the rolling mill can easily be disassembled and reassembled.

Figure 10:
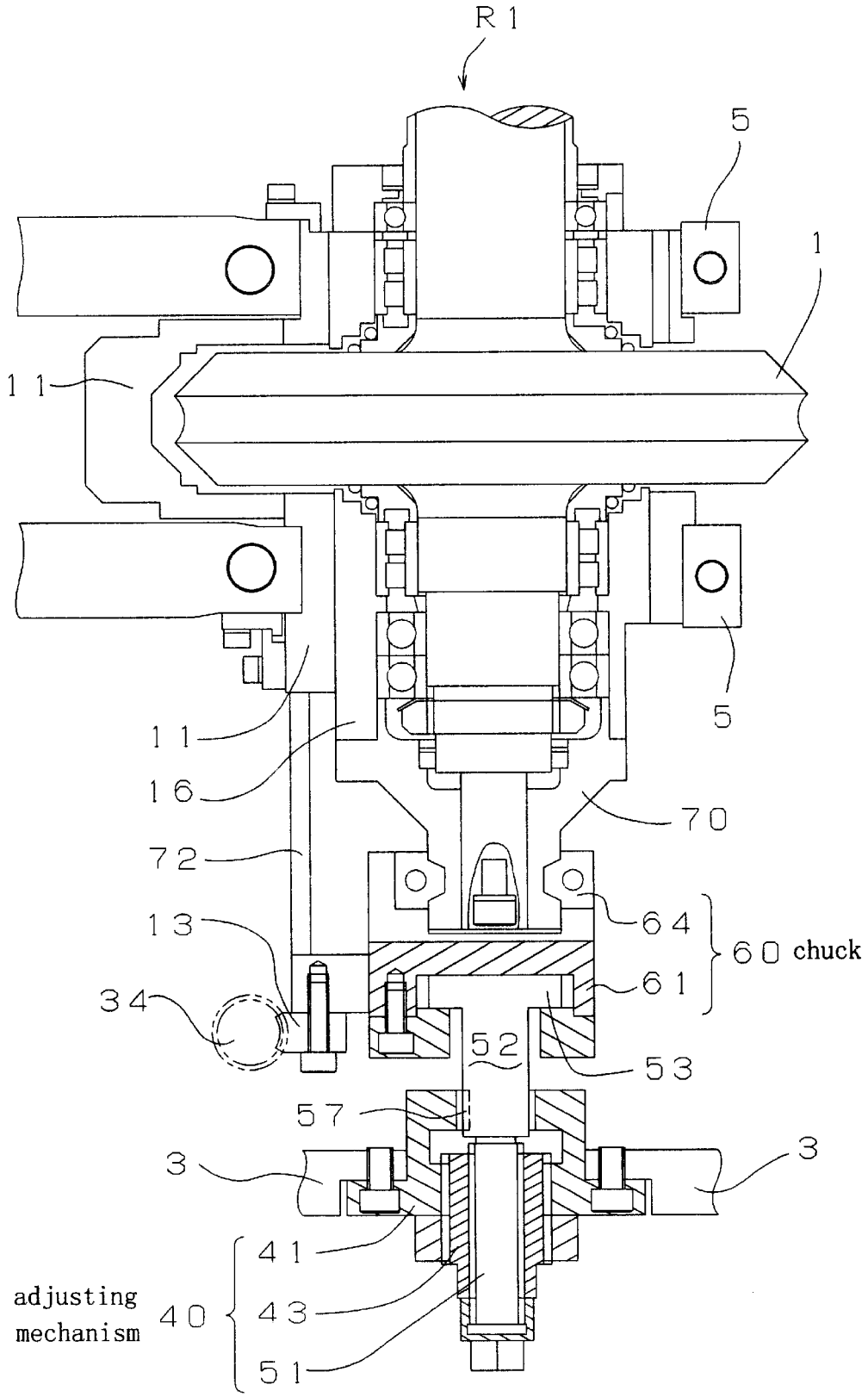
FIG. 10 is a top view of one embodiment of a roll-alignment adjusting device of the present invention.
Figure 11:
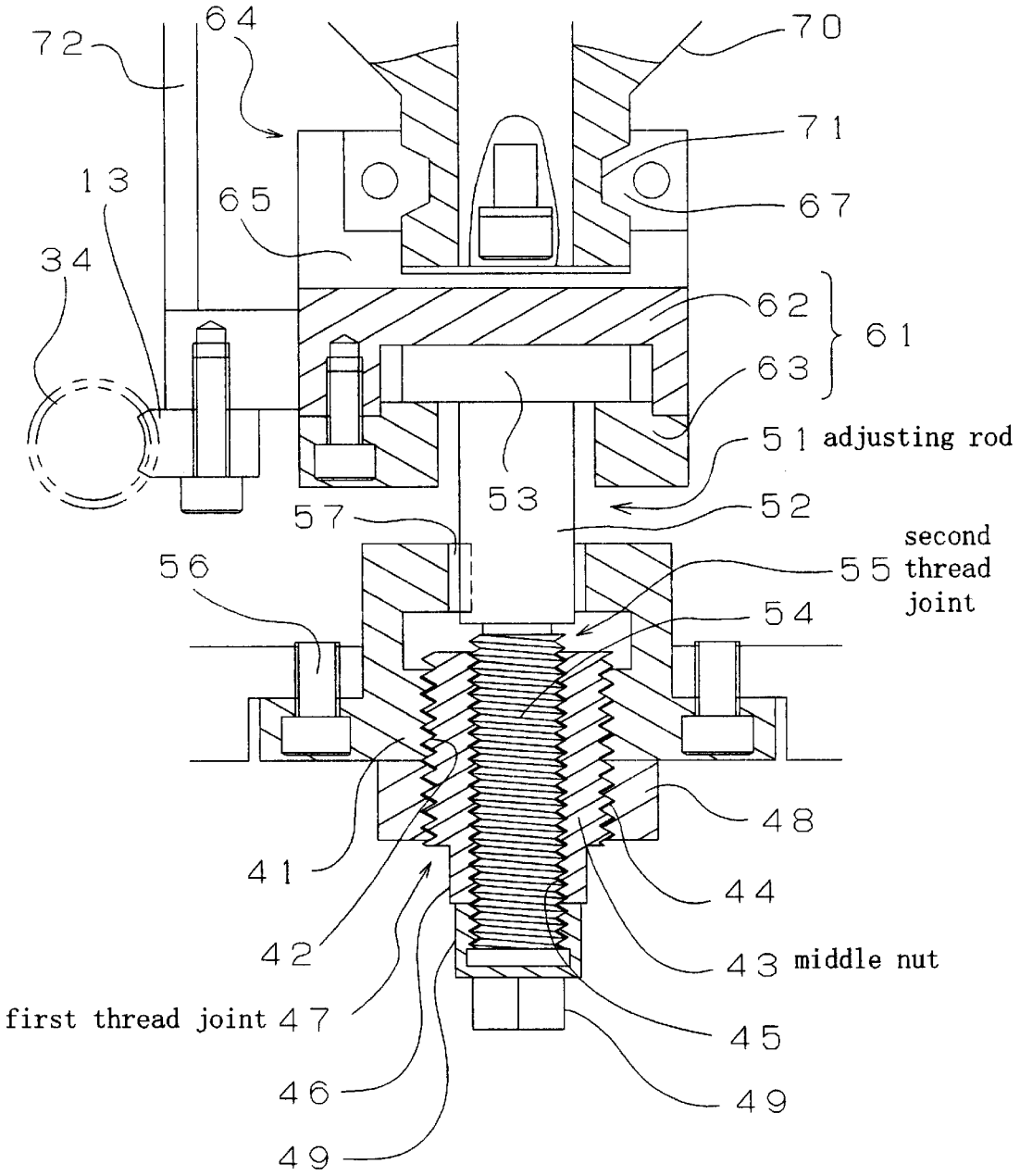
FIG. 11 is an enlarged top view of the adjusting mechanism 40 of FIG. 10.
Figure 12:
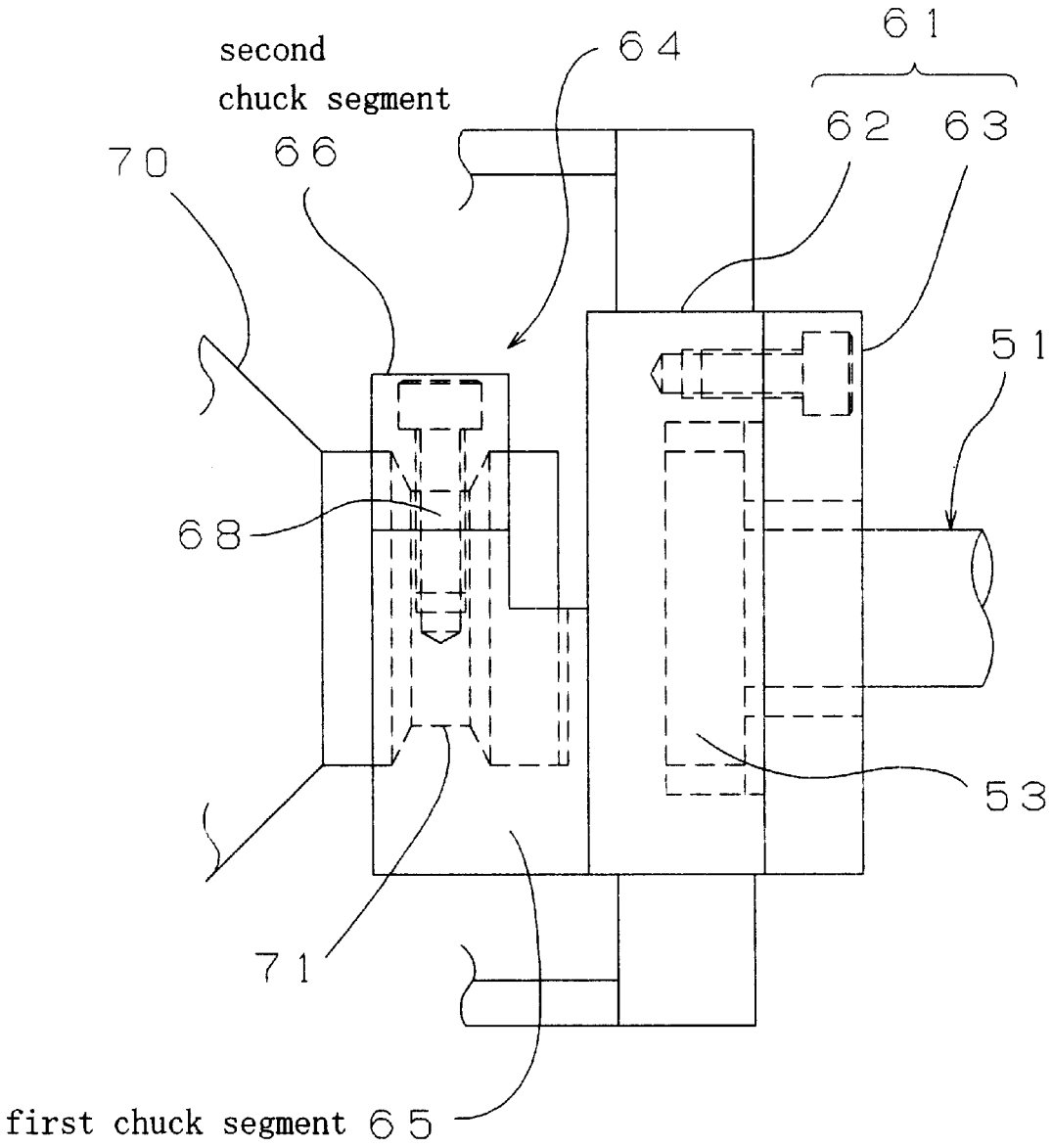
FIG. 12 is a side view of the chuck 60 of FIG. 10.

With reference to FIGS. 10–12, the roll-alignment adjusting device will now be described.

As shown in FIGS. 10 and 11, the roll-alignment adjusting device comprises an adjusting mechanism 40 and a chuck 60.

The adjusting mechanism 40 comprises an outer nut 41, a middle nut 43, and an adjusting rod 51.

The outer nut 41 has internal threads 42 and is fixed to the first housing segment 3 by bolts 56. The outer nut 41 is covered by a semicircular recess of the second housing segment 4 but not fixed to the second housing segment 4.

The middle nut 43 has external threads 44 and internal threads 45, and its outer end portion 46 is formed into a hexagonal shape, on which a wrench or the like is fitted.

The middle nut 43 is screwed in the outer nut 41, and the internal threads 42 and the external threads 44 constitute a first thread joint 47. A lock nut 48 is provided for the middle nut 43.

The adjusting rod 51 is a rod member 52 which has an engaging flange 53 on its base end, the engaging flange 53 and the rod member 52 being of unitary construction, and external threads 54 on its forward potion. Besides, the rod member 52 is prohibited to rotate but permitted only to move in its axial direction by its engagement with a sliding key 57 which is formed inside the outer nut 41.

The external threads 54 of the adjusting rod 51 engages the internal threads 45 of the middle nut 43, and the external threads 54 and the internal threads 45 constitute the second thread joint 55.

A lock nut 49 is provided to eliminate the backlash of the adjusting rod 51.

The first thread joint 47 and the second thread joint 55 have each a thread of the opposite hand; for example, if the former has a right-hand thread, the latter has a left-hand thread. Besides, their thread pitches are differentiated a little.

Accordingly, when the middle nut 43 is turned with a tool, the middle nut 43 advances in the outer nut 41 but the adjusting rod 51 retreats; hence the resultant advancement of the adjusting rod 51 is very small. Thus, the fine adjustment of alignment can easily be accomplished.

As shown in FIGS. 10–12, each chuck 60 consists essentially of the first joint section 61 to catch the engaging flange 53 of the adjusting rod 51 and the second joint section 64 to catch the shaft end 70 of the roll unit R1.

The first joint section 61 consists essentially of a base portion 62 in which a recess is formed and a flange portion 63 brought through from the other end of the adjusting rod 51, and catch the engaging flange 53 between the bottom of the recess of the base portion 62 and the flange portion 63.

The second joint section 64 consists essentially of the first chuck segment 65 to support the lower half of the shaft end 70 and the second chuck segment 66 to hold down the upper half of the shaft end 70.

A trapezoidal groove 71 is circumferentially formed on the end portion 70 of the shaft of the roll unit R1, and a trapezoidal protrusion 67 is circumferentially formed inside the first and second chuck segments 65 and 66. Accordingly, both the axial and radial slippage between the roll unit R1 and the second joint section 64 is prohibited.

The second chuck segment 66 is joined to the first chuck segment 65 by bolts 68, and the second chuck segment 66 is not fixed to the second housing segment 4. On the other hand, the first chuck segment 65 is connected to the first cartridge segment 11 of the eccentric cartridge, described earlier, by a connecting bar 72.

Accordingly, when the second housing segment 4 is separated from the first housing segment 3, the chuck 60 is left on the first housing segment 3. Therefore, by removing only the bolts 68 and the second chuck segment 66, the roll unit R1 can be taken out from the first housing segment 3.

Besides, as the adjusting mechanism 40 remains intact on the first housing segment 3, the alignment is not affected, and the zero adjustment among a plurality of roll units is unnecessary during the reassembly. Only the fine adjustment due to the roll change is necessary; thus, the alignment after the reassembly can easily be adjusted.

Although the embodiment described above is concerned with a four-roll rolling mill, the present invention can also be applied to three- and two-roll rolling mills.

The invention may be embodied in other specific forms without departing from the spirit or essential characteristics thereof. The above embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What we claim is:

1. A rolling mill comprising:

a housing;

a plurality of roll units which are mounted on the housing, each roll unit having a shaft;

a rolling-reduction adjusting device of an eccentric-cartridge type to adjust the rolling reduction of the roll units, the rolling reduction adjusting device mounted on the housing; and a roll-alignment adjusting device which is mounted on the housing, the housing split into freely separable and joinable first and second housing segments, the first housing segment having semicircular bearing-holder segments formed in its joint surface, the second housing segment having semicircular bearing-holder segments formed in its joint surface, the shafts of the roll units being held between the first and second housing segments by being journaled in the eccentric cartridges which are fitted in the bearing holders consisting of the semicircular bearing-holder segments.

2. A rolling mill as claimed in claim 1 of which a driving mechanism of the rolling-reduction adjusting device is mounted entirely on the first housing segment.

3. A rolling mill as claimed in claim 1 wherein any of the roll units is or are a driving roll unit or units, each eccentric cartridge of the rolling-reduction adjusting device of the driving roll unit or units consisting of first and second semicircular cartridge segments, the first semicircular cartridge segment fitted in the semicircular bearing-holder segment of the first housing segment, the second semicircular cartridge segment fitted in the semicircular bearing-holder segment of the second housing segment.

4. A rolling mill as claimed in claim 3 wherein the shaft or shafts of the driving roll unit or units is or are journaled in bearings which are fitted in concentric sleeves which are in turn accommodate in eccentric cartridges consisting of the first and second semicircular cartridge segments.

5. A rolling mill as claimed in claim 1 wherein the roll-alignment adjusting device comprises:

adjusting mechanisms each of which further comprises (i) an outer nut which is fixed to the housing and has internal threads, (ii) a middle nut which has internal and external threads, the external threads engaging the internal threads of the outer nut, and is rotated externally, and (iii) an adjusting rod which has external threads to engage the internal threads of the middle nut, a first thread joint defined by the internal threads of the outer nut and the external threads of the middle nut and a second thread joint defined by the internal threads of the middle nut and the external threads of the adjusting rod given each a thread of the opposite hand and a different pitch; and chucks to connect shaft ends of the roll units to the adjusting rods of the adjusting mechanisms.

6. A rolling mill as claimed in claim 5 wherein:

the outer nut of each adjusting mechanism is fixed to the first housing segment; and the chucks are a split type, each consisting essentially of first and second chuck segments, the second chuck segment being freely removable from, and attachable to, the first chuck segment.

* * * * *